US008459996B2

(12) United States Patent
Sullivan

(10) Patent No.: US 8,459,996 B2
(45) Date of Patent: Jun. 11, 2013

(54) TRAINING DEVICE FOR GRENADE LAUNCHERS

(75) Inventor: Kevin Michael Sullivan, Kennebunk, ME (US)

(73) Assignee: KMS Consulting, LLC, Kennebunk, ME (US)

( * ) Notice: Subject to any disclaimer, the term of this patent is extended or adjusted under 35 U.S.C. 154(b) by 282 days.

(21) Appl. No.: 12/858,279

(22) Filed: Aug. 17, 2010

(65) Prior Publication Data

US 2012/0183929 A1 Jul. 19, 2012

Related U.S. Application Data

(60) Provisional application No. 61/274,440, filed on Aug. 17, 2009.

(51) Int. Cl.

| | |
|---|---|
| ***F41A 33/00*** | (2006.01) |
| ***F41G 3/26*** | (2006.01) |
| ***F41G 1/00*** | (2006.01) |
| ***F41A 33/02*** | (2006.01) |

(52) U.S. Cl.

CPC ..... *F41A 33/02* (2013.01); *F41G 3/2622* (2013.01)

USPC ..... 434/16; 434/11; 434/21; 42/114

(58) Field of Classification Search

USPC ..... 434/11, 16, 19

See application file for complete search history.

(56) References Cited

U.S. PATENT DOCUMENTS

| | | | | |
|---|---|---|---|---|
| 3,609,883 | A | 10/1971 | Erhard | |
| 4,264,309 | A * | 4/1981 | Brooksby | 434/20 |
| 4,315,689 | A | 2/1982 | Goda | |
| 5,474,452 | A * | 12/1995 | Campagnuolo | 434/11 |
| 6,059,573 | A | 5/2000 | Patel | |
| 6,065,404 | A | 5/2000 | Ripingill, Jr. et al. | |
| 6,363,648 | B1 * | 4/2002 | Kranich et al. | 42/117 |
| 6,386,879 | B1 * | 5/2002 | Varshneya et al. | 434/16 |
| 7,052,276 | B2 * | 5/2006 | Davidsson et al. | 434/11 |
| 8,047,118 | B1 * | 11/2011 | Teetzel et al. | 89/41.17 |
| 2003/0027103 | A1 * | 2/2003 | Preston et al. | 434/11 |
| 2006/0048432 | A1 * | 3/2006 | Staley, III | 42/122 |

(Continued)

OTHER PUBLICATIONS

"Multiple Integrated Laser Engagement System" [online], [retrieved on Jul. 19, 2012]. Retrieved from the Internet <URL:http://en.wikipedia.org/wiki/Multiple_Integrated_Laser_Engagement_System>.*

*Primary Examiner* — Kathleen Mosser

*Assistant Examiner* — Peter J Alley

(74) *Attorney, Agent, or Firm* — Karl F. Milde, Jr.; Eckert Seamans Cherin & Mellott, LLC

(57) ABSTRACT

A laser-based system is useful for training soldiers in the operation and use of a grenade launcher. The system comprises a training assembly rotatably attached to the body of a grenade launcher and at least one sensor to detect laser energy at a target site. The training assembly comprises a housing; a variable output laser; a shaft extending through the housing to the body of the grenade launcher; a motor within the housing that engages the shaft and is capable of causing the housing to rotate about the shaft; at least one sensor to detect rotation of the housing, trigger pull, and/or gravitational direction; and a control unit operationally connected to the laser, the at least one sensor, and the motor. The training assembly rotates from the elevation of the launcher barrel to the elevation of the target site to generate a burst of laser energy at sensors at the target site.

11 Claims, 14 Drawing Sheets

U.S. PATENT DOCUMENTS * cited by examiner

| | | | | |
|---|---|---|---|---|
| 2007/0026364 | A1 | 2/2007 | Jones et al. | |
| 2007/0264616 | A1* | 11/2007 | Namgung | 434/16 |
| 2009/0305197 | A1* | 12/2009 | Lim et al. | 434/16 |
| 2011/0281242 | A1* | 11/2011 | Charles et al. | 434/16 |
| 2012/0096755 | A1* | 4/2012 | Griffin | 42/105 |

TRAINING DEVICE FOR GRENADE LAUNCHERS

CROSS-REFERENCE TO RELATED APPLICATION

This application is based upon and claims the priority of commonly assigned U.S. Provisional Patent Application Ser. No. 61/274,440, filed Aug. 17, 2009, incorporated herein by reference in its entirety.

FIELD OF THE INVENTION

This invention is directed to a system for military training. More particularly, this invention is directed to a system allowing for realistic force-on-force simulated training with low velocity grenade launchers, high velocity grenade launchers, and certain shoulder-launched weapons.

BACKGROUND OF THE INVENTION

The U.S. military, as well as military forces in other countries, has trained soldiers for many years with a multiple integrated laser engagement system (MILES). One aspect of MILES involves a small arms laser transmitter (SAT), such as a gallium arsenide laser transmitter, which is affixed to the barrel of a small arms weapon or a machine gun. The soldier pulls the trigger of his or her weapon to fire a blank or blanks to simulate the firing of an actual round or multiple rounds. Each soldier is fitted with laser sensitive optical detectors on his or her helmet and on a body harness adapted to detect an infrared laser "bullet" hit. A semiconductor laser diode in the SAT is energized to emit an infrared laser beam toward the target in the conventional sights of the weapon. The infrared laser beam is encoded with the solder's player identification code. Optionally each soldier wears a digital player control unit that tells the player whether he or she has suffered a particular type of casualty or had a near miss, the time of the event and the identity of the shooter.

The MILES devices allow for realistic force-on-force training (simulation) of military forces. MILES systems work very effectively with direct fire weapons. However, the training of weapons with indirect fire ballistics, such as modern grenade weapons, including but not limited to, MK19, MK47, M203, M79, M320, and MK13 grenade launchers, is not compatible with MILES systems.

The launching of grenades or other projectiles in a combat situation is an important art of military operations. There has been a definite need to provide more effective training for automatic or hand-held grenade launchers.

SUMMARY OF THE INVENTION

It is an objective of this invention to provide a novel system for military training.

It is also an objective of this invention to provide an effective training for weapons that launch grenades or other projectiles.

These objectives, as well as further objectives which will become apparent from the discussion that follows, are achieved, according to the present invention, by providing a novel system useful for training soldiers in the operation and/or use of a grenade launcher. The system includes a training assembly with a laser having a focal array to direct the laser beam. A control unit or controller records and measures the angle between the longitudinal axis of the training assembly housing and the barrel bore elevation (or longitudinal axis), the initiation of a blank (or simulated) trigger pull, and the direction of earth gravity.

The training assembly is rotatably attached or connected via a shaft or connection member to the body of a grenade launcher comprising a body and a barrel. The training assembly initially is positioned so that the longitudinal axis of the training assembly and/or the direction of the laser is substantially parallel to the longitudinal axis of the barrel.

Once a solider aims the grenade launcher in an intended direction, so that both the barrel and training assembly are pointed in an elevated manner, the solider then pulls the trigger to simulate a firing. After sensing the firing, the training assembly rotates in a clockwise or counterclockwise manner (dependent upon position) at a rate corresponding to the post firing trajectory of a projectile or cartridge. The rotation is configured so that the longitudinal axis of the training assembly reaches horizontal, or an elevation depressed or elevated from horizontal, at the time that a projectile or cartridge would land. The output of the laser increases as the training assembly rotates. Beam divergence can be optimized to replicate a lethal impact area.

In another aspect of the invention, the training assembly is positioned or moves in the x-direction to simulate expected drift due to either the inertia of the ballistics or wind, or both.

The laser comprises a lower power laser suitable for emitting useful radiation. For example, semiconductor laser diodes emit useful radiation having wavelengths in the range of from about 850 to about 910 nanometers.

A connector member or connector connects the training assembly to the body of a grenade launcher. The connection member comprises a shaft, and a motor in the training assembly engages the shaft to enable the training assembly to rotate as intended. Also, in one embodiment of the invention, the motor and shaft or shaft and connection member are configured so that the training assembly can rotate away from a vertical plane of the grenade launcher, in the x-direction.

The axis of device rotation and bore alignment are configured to simulate drift as the training assembly deflects. Burst fire is simulated as trigger pull/blank fire initiates delayed laser shots.

The training assembly comprises sensors to measure, for example, the direction of earth gravity, the position or elevation of the training assembly as compared to horizontal or the elevation of a target site or area (an inclinometer), the angle of the assembly to the bore elevation, movement or the rate of movement (an accelerometer), or the initiation of a blank or simulated trigger pull, or two or more of the foregoing.

A control unit, or controller, is operatively connected to the laser, the motor, and the sensors.

In another aspect of the invention one or more MILES sensors are positioned at the intended target area. As the training device rotates to horizontal or, if not horizontal, the elevation of a target area, a laser beam hits one or more sensors to register a successful fire.

The strength of the laser beams can vary. As the training device rotates to horizontal or, if not horizontal, the elevation of a target area, the laser beam should be at full strength, to reach the sensors at the target areas.

In another aspect of the invention, a system useful for training soldiers in the operation and use of a grenade launcher having a body and a barrel, comprises:

a training assembly capable of being rotatably attached to the body of the launcher, comprising:

a housing;

a variable output laser within the housing to produce a laser beam along a longitudinal axis;

a shaft extending through the housing to the body of the grenade launcher;

a motor within the housing that engages the shaft and is capable of causing the housing to rotate about the shaft;

at least one sensor within the housing or attached to the housing to detect rotation of the housing, trigger pull, and/or gravitational direction; and a control unit within the housing or attached to the housing and operationally connected to the laser, the at least one sensor, and the motor; and at least one sensor to detect laser energy at a target site.

In another aspect of the invention, the laser has a focal array to direct the laser beam.

In another aspect of the invention, the control unit records and measures an angle between the longitudinal axis of the housing and the barrel elevation, the initiation of a blank or simulated trigger pull, and the direction of earth gravity.

In another aspect of the invention, the training assembly is rotatably attached or connected to the body of the grenade launcher.

In another aspect of the invention, the training assembly is attached or connected through a shaft or connector.

In another aspect of the invention, the training assembly initially is positioned so that a longitudinal axis of the training assembly and the laser beam is substantially parallel to a longitudinal axis of the barrel.

In another aspect of the invention, sensors to sense radiation are positioned at an intended target area.

In another aspect of the invention, as the training device rotates to the elevation corresponding to the target area, a laser beam hits one or more sensors to register a successful fire.

In another aspect of the invention, the training assembly is positioned or moves in the x-direction to simulate expected drift due to at least one of the inertia of the ballistics and wind.

In another aspect of the invention, the laser comprises a lower power laser suitable for emitting useful radiation.

In another aspect of the invention, a shaft extends through or comprises a connector member to connect the training assembly to the body of a grenade launcher.

In another aspect of the invention, a motor in the training assembly engages the shaft to enable the training assembly to rotate as intended.

In another aspect of the invention, the motor and shaft are configured so that the training assembly can rotate away from a vertical plane of the grenade launcher, in the x-direction.

In another aspect of the invention, the axis of device rotation and bore alignment are configured to simulate drift as the training assembly deflects.

In another aspect of the invention, the sensors in the training assembly measure at least one of the direction of earth gravity, the position or elevation of the training assembly as compared to horizontal, the angle of the assembly to the bore elevation, movement or the rate of movement, and the initiation of a blank or simulated trigger pull.

In another aspect of the invention, a method of training an individual to fire a grenade launcher comprises the steps of:

providing a grenade launcher having a barrel and a body and a training assembly rotatably attached to the body of the grenade launcher;

aiming the grenade launcher in an intended direction, and aiming the training assembly in the same direction, so that both the barrel and training assembly are pointed in an elevated manner;

pulling a trigger of the grenade launcher to simulate a firing; and after firing, rotating the training assembly rotates at a rate corresponding to the post firing trajectory of a projectile or cartridge and for a time corresponding to the time it would take a projectile to land at a target area, thereby causing the laser a beam to actuate at least one sensor at the target area.

For a full understanding of the present invention, reference should now be made to the following detailed description of the preferred embodiments of the invention as illustrated in the accompanying drawings.

BRIEF DESCRIPTION OF THE DRAWINGS

FIGS. 2A and 2B are schematic representations of a substantially cross-sectional top view and lateral view, respectively, of a training assembly according to the invention;

DETAILED DESCRIPTION OF THE DRAWINGS

Figure 1A:
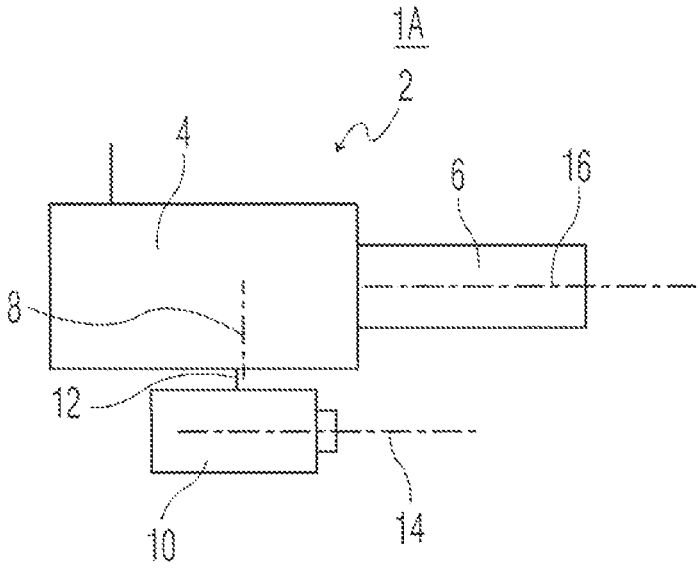
FIGS. 1A and 2B are schematic representations of a top view and a lateral view, respectively, of a training assembly according to the invention attached to a grenade launcher.

The preferred embodiments of the present invention will now be described with reference to FIGS. 1-15 of the drawings. Identical elements in the various figures are designated with the same reference numerals.

Figure 1B:
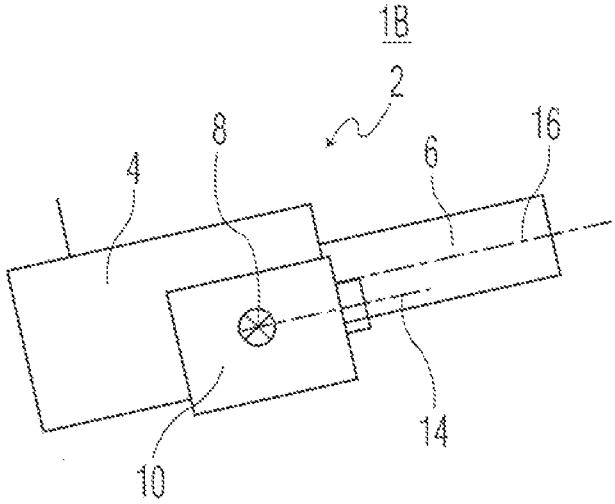

In the schematic representations of a top view and a lateral view, respectively, shown in FIGS. 1A and 1B, an automated grenade launcher ("AGL") 2, such as an MK19 or MK47, has a body 4 and a barrel 6. A training assembly 10 is attached through a connector 12 to body 4 for rotation about a transverse axis 8. The longitudinal axis 14 of training assembly 10 is initially parallel to the longitudinal axis 16 of barrel 6.

Figure 2A:
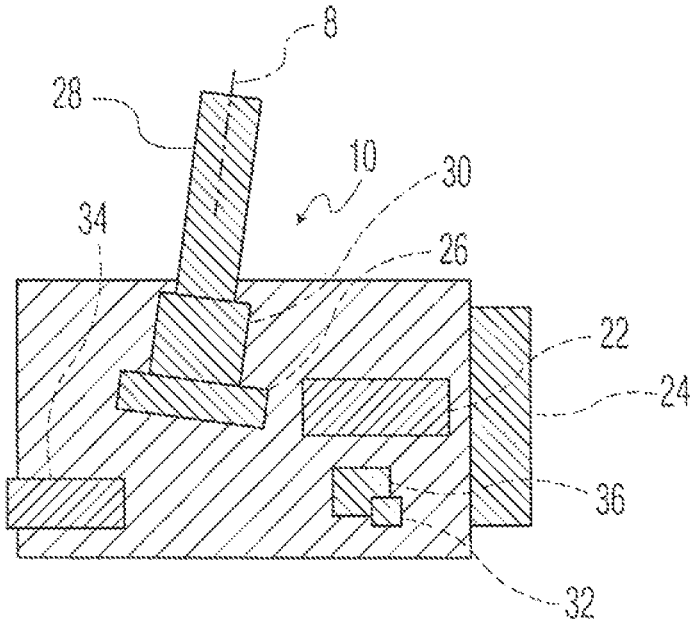
Figure 2B:
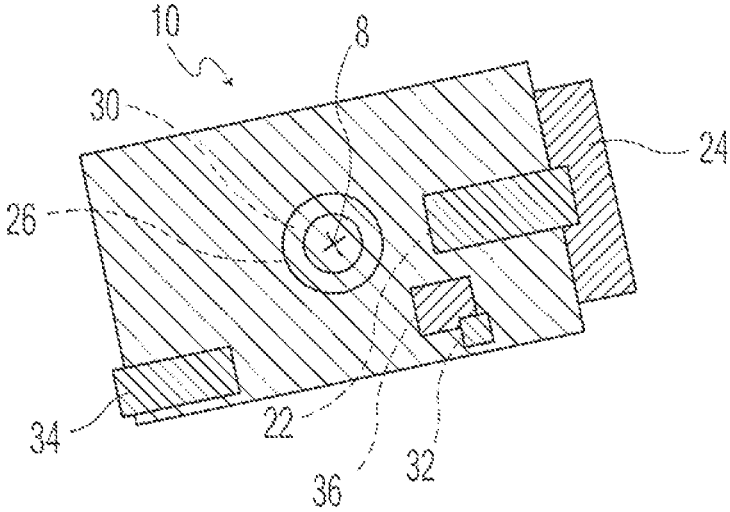

FIGS. 2A and 2B comprise schematic representations of substantially cross-sectional top and lateral views, respectively, of a training assembly 10. Training assembly 10 comprises a laser 22 that generates a beam that passes through focal array 24. A motor 26 is operationally connected to a connector/shaft 28 to rotate training assembly 10 about connector/shaft 28. Connector/shaft 28 connects to the body of a grenade launcher, such as body 4.

The training assembly 10 has an angular position sensor 30 to measure rotation about connector/shaft 28, and an inclinator or gravity sensor 32 to determine the direction of the vertical and thus the position with respect to the horizontal. There is also a sensor 34, such as a recoil sensor or trigger switch, for sensing an actual or simulated trigger pull of the grenade launcher 2. A control circuit or controller 36 is coupled to receive outputs from all the sensors and control the operation of the motor 26 to rotate the training assembly 10 clockwise about the transverse axis 8.

For a hand held device, such as an M203 or M320 grenade launcher, training assembly 10 may optimally comprise a stabilizer (not shown). The stabilizer would allow the training assembly 10 to counter hand movement after firing.

Figure 3A:
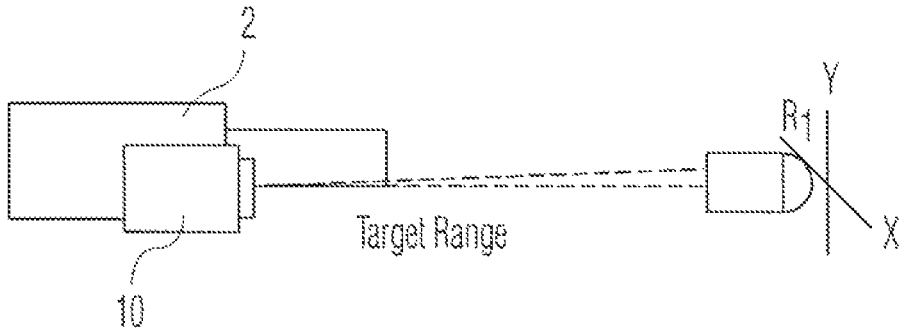
FIGS. 3A and 3B are schematic representations of a training system according to the invention.
Figure 3B:
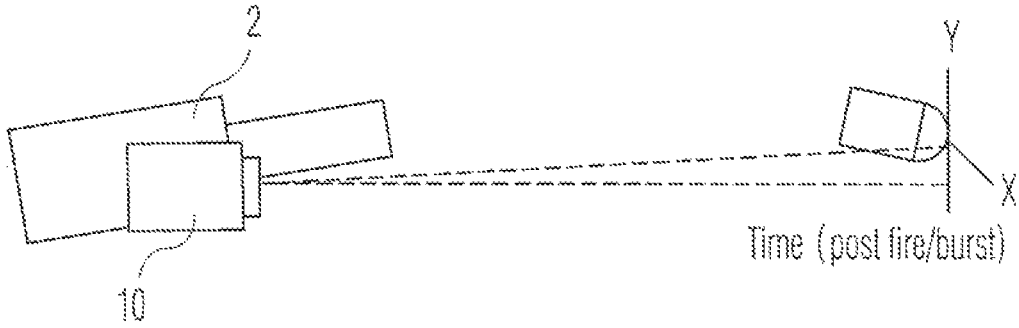

The schematic representations in FIGS. 3A and 3B represent firing sequences. FIG. 3A represents a lateral view of the training assembly 10 attached to the automated grenade launcher 2. Upon sensing a blank firing (or simulated trigger pull), training assembly 10 rotates (depresses) in a clockwise or y-direction at a rate that simulates the post firing trajectory (y-position/drop) of a projectile in flight. The gravity sensor 32 in the training assembly 10 measures the relative position or effect of gravity, which, in turn, affects the ballistics of the automated grenade launcher (AGL). The controller 36 in the training assembly 10 controls the motor 26 that adjusts the rate of rotation imparted by the motor 26, also factoring in the relative elevation of firing position as compared to the target position.

The rate of rotation of the training assembly 10 allows for alignment of the laser (with targets) at time intervals. The time intervals and alignment resulting from rotation/depression of the training assembly coincide with the simulated ballistic position/drop of a projectile (e.g., a 40 mm projectile) in flight.

As the training assembly 10 is rotated clockwise about the axis 8, the intensity of the laser is increased by the controller 36. At shorter distances, the laser output is lower. In FIGS. 3A and 3B, the terminal laser light is optimized to reasonably match the range and dispersion of the projectile.

Figure 4:
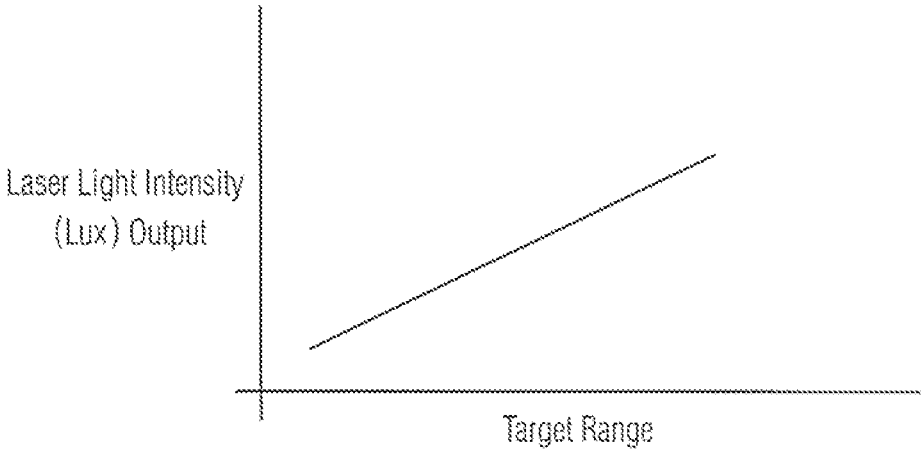
FIG. 4 is a graph of the intensity of laser light output versus range or time.

The graph shown in FIG. 4 provides an example of the increase in intensity of the laser output over distance and/or time.

Figure 5:
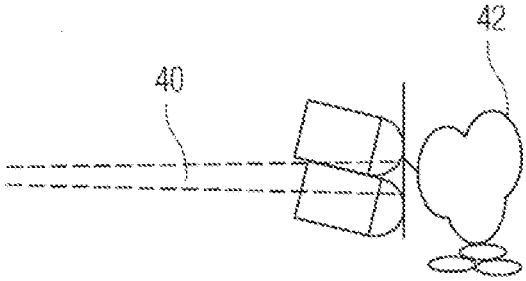
FIG. 5 is a schematic representation of a laser beam dispersion pattern at a target.

FIG. 5 is a schematic representation of the width of a laser beam 40 at a simulated target point 42. The laser beam width is intended to approximate the width of a projectile burst at that distance. The focal array 24 on training assembly 10 can change the laser beam dispersion at an intended range.

Figure 6A:
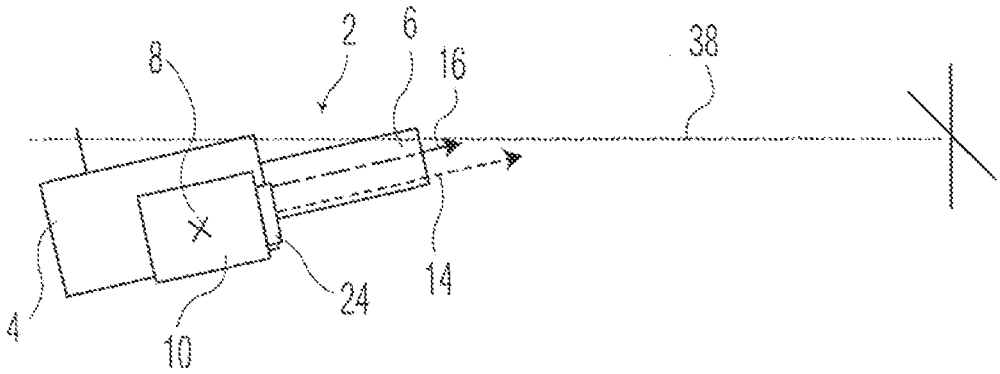
FIGS. 6A to 6D are schematic representations of lateral views of use of a training assembly mounted on a grenade launcher.
Figure 6B:
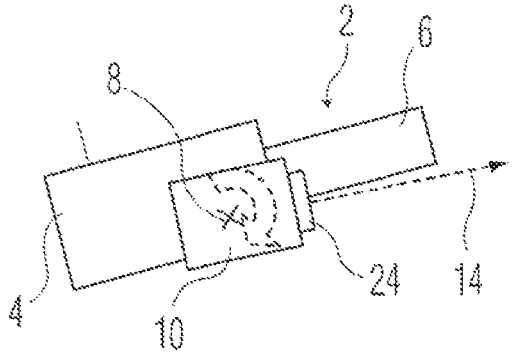
Figure 6C:
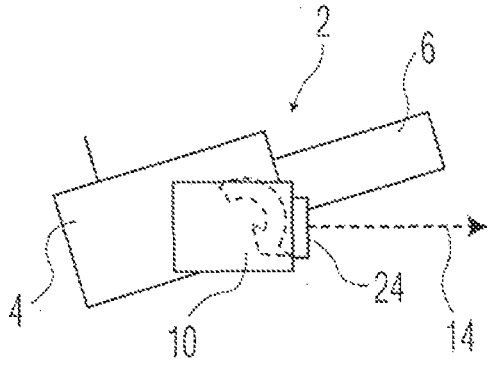
Figure 6D:
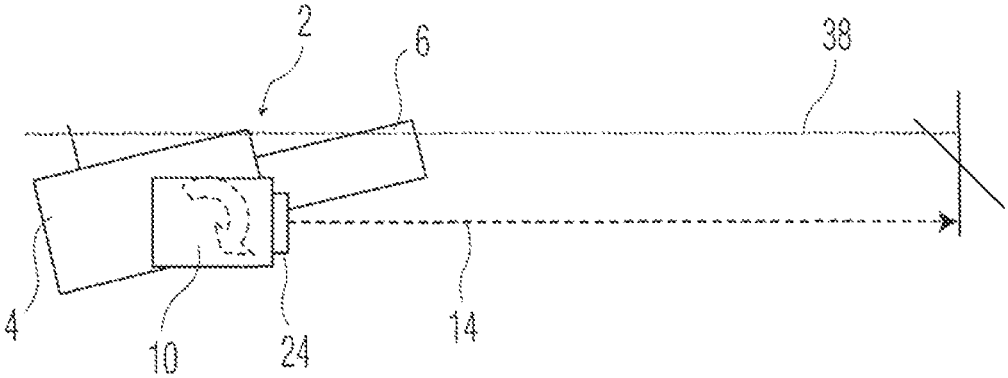
Figure 7A:
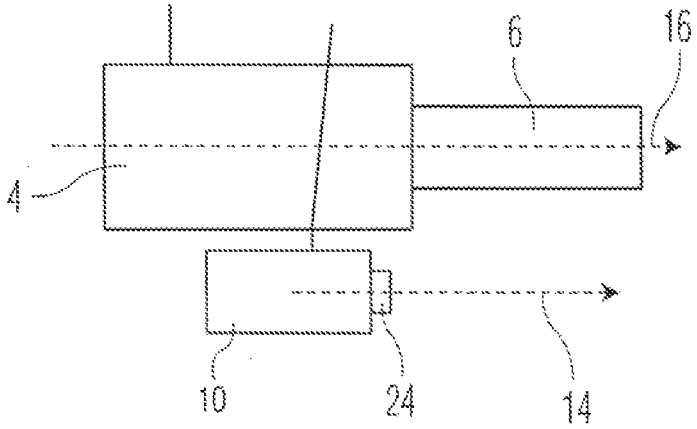
FIGS. 7A to 7D are schematic representations of top views of the training assembly and grenade launcher shown in FIGS. 6A to 6D, respectively.
Figure 7B:
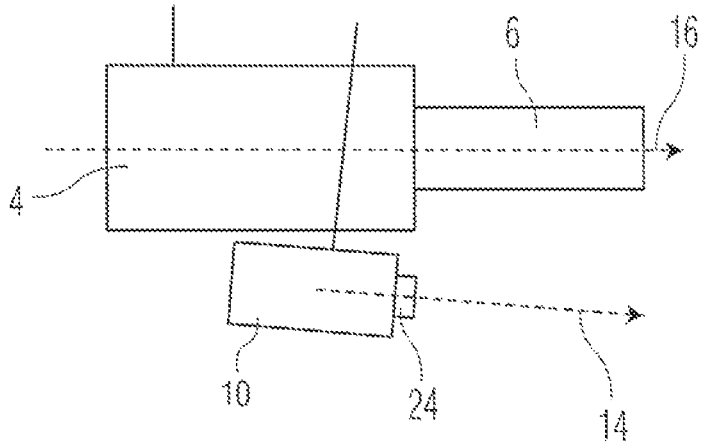
Figure 7C:
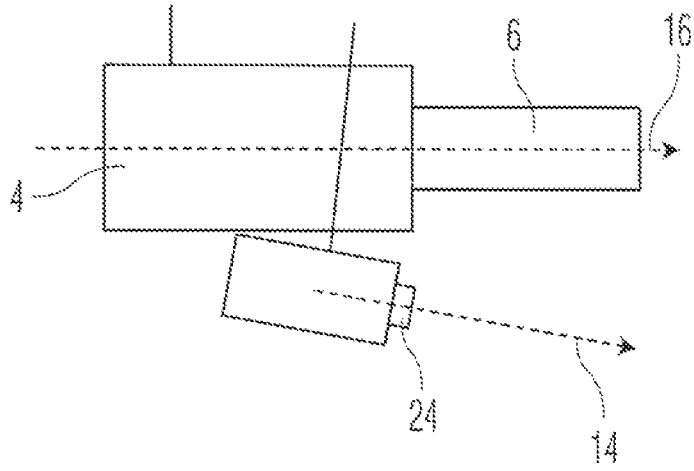
Figure 7D:
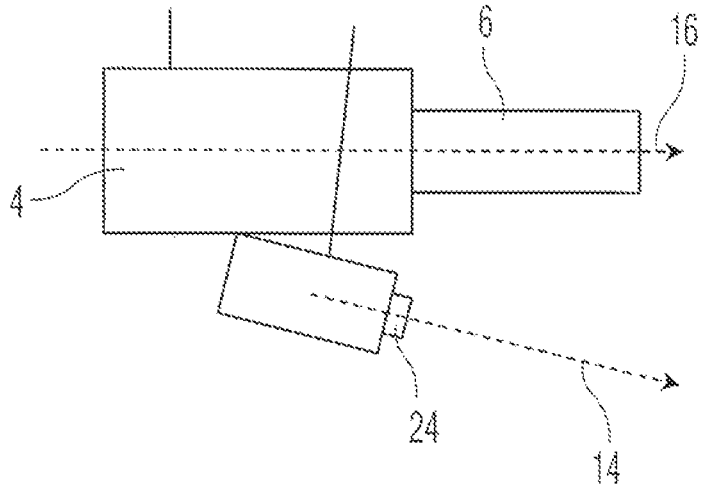

Another aspect of the invention is shown in lateral views in FIGS. 6A to 6D and in top views in FIGS. 7A to 7D. In FIG. 6A a training assembly 10 is rotatably mounted on a grenade launcher 2 having a body 4 and a barrel 6. A focal array 24 of the training assembly 10 focuses a laser beam along the longitudinal axis 14, which is parallel in the y-direction to longitudinal axis 16 of the barrel 6. A gunner's line of sight 30 extends from the rear of grenade launcher 2 to a target (not shown). In FIG. 7A, as shown in a top view, longitudinal axis 14 is parallel to longitudinal axis 16 in the x-direction.

A gunner aligns a weapon sight with a target, as shown in FIG. 6A, and the training assembly 10 is aligned with the bore of barrel 6 when grenade launcher 2 is "fired". After the training assembly 10 senses firing, the rate of rotation or depression of the training assembly 10, as shown in FIGS. 6B and 6C, coincides with the simulated post firing "y" ballistic position of a projectile, as represented in the graph in FIG. 8. The laser fires light pulses as the training assembly 10 rotates.

The lateral view of FIG. 6D is intended to represent a composite of the initial gunner's line of sight to the target, as compared to the laser beam aligned to the target as the training assembly 10 is rotated to its final position, which is horizontal or, if not horizontal, is either depressed or elevated from the horizontal.

The power of the laser increases as the training assembly 10 rotates. Thus, as the training assembly 10 rotates to a position corresponding to the elevation of the target, the controller 36 increases the laser power to a point that the light output triggers MILES sensors.

The top views of FIGS. 7A to 7D correlate to the lateral views of FIGS. 6A to 6D, respectively. As the training assembly 10 rotates, the "x" (lateral) alignment between the grenade launcher 2 and the training assembly 10 simulates the actual "x" drift of a projectile in flight.

The movement of the training assembly 10 in the "x" direction away from the grenade launcher barrel axis 16 is intended to replicate the actual "x" drift of a projectile in flight due to its rotation. The shift in "x" misalignment with the barrel axis 16 occurs as the training assembly rotates in the "y" direction.

Figure 8:
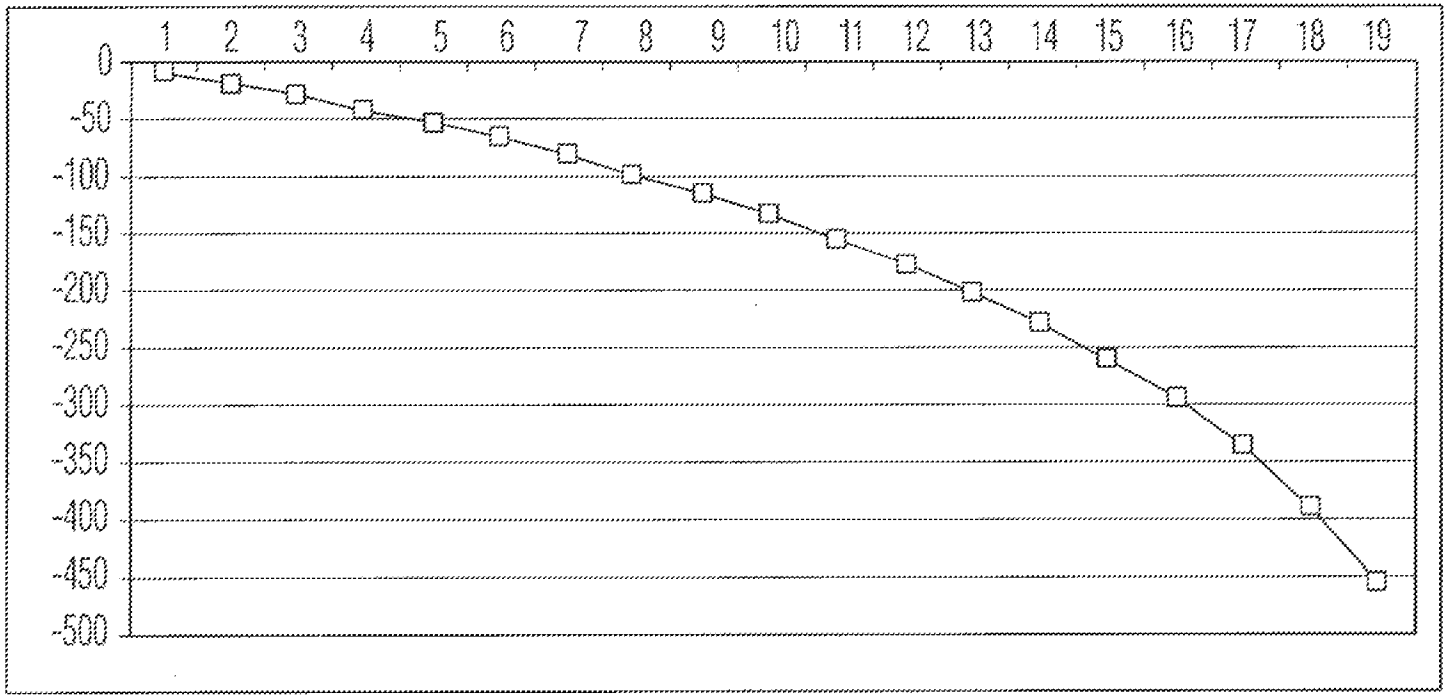
FIG. 8 is a graph representing depression angle verses time.

The graph in FIG. 8 represents the projected depression angle in mils over a period of time for a simulated trajectory of a grenade or other projectile.

Figure 9A:
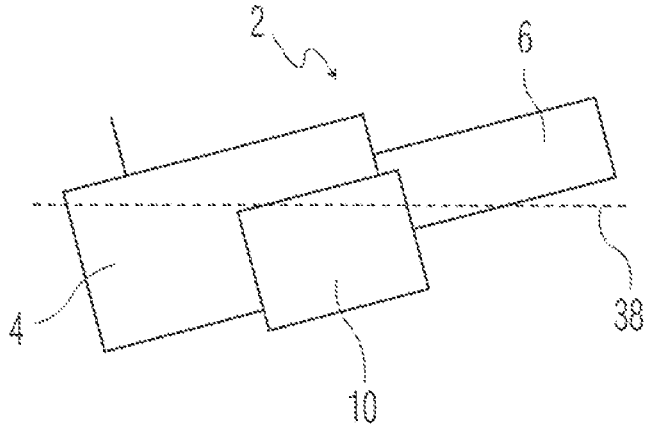
FIGS. 9A and 9B are schematic representations of lateral views of use of a training assembly mounted on a grenade launcher.
Figure 9B:
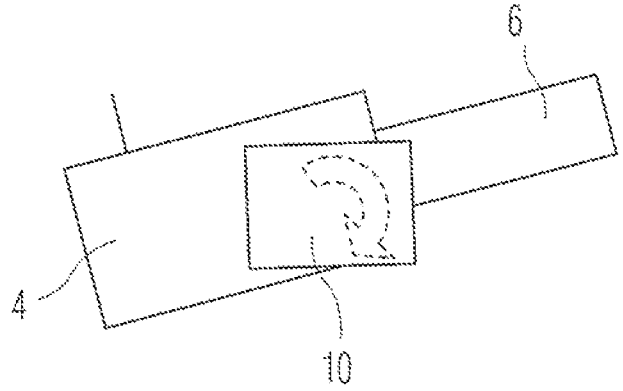

The relationship between rotation of a training assembly and drift is shown with more particularity in FIGS. 9A to 10B. FIGS. 9A and 9B are lateral views of a training assembly 10 positioned on a grenade launcher 2 having a body 4 and a barrel 6. FIG. 9A represents the training assembly 10 and grenade launcher 2 at firing, while FIG. 9B represents a post firing configuration where the training assembly 10 has rotated in a clockwise manner.

Figure 10A:
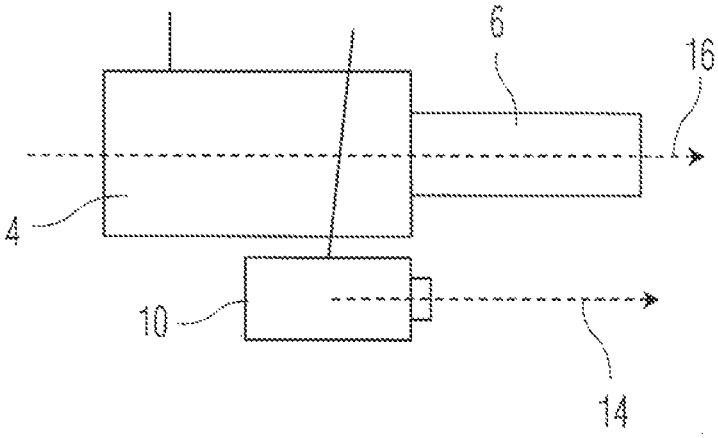
FIGS. 10A and 10B are schematic representations of top views of the training assembly and grenade launcher shown in FIGS. 9A and 9B, respectively.
Figure 10B:
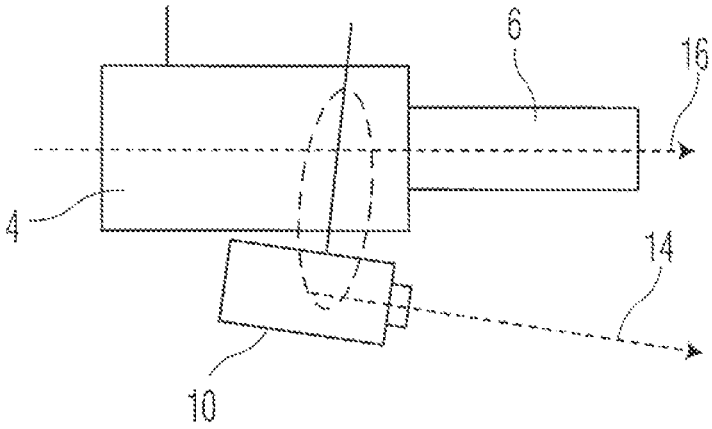

In the corresponding top views of FIGS. 10A and 10B, a longitudinal axis or centerline 16 of barrel 6 is parallel to a longitudinal axis 14 of the laser beam from the training assembly 10. As seen in FIG. 10B, however, the angular rotation of longitudinal axis 14 away from longitudinal axis 16 matches or approximates actual ballistic projectile drift.

Figure 11:
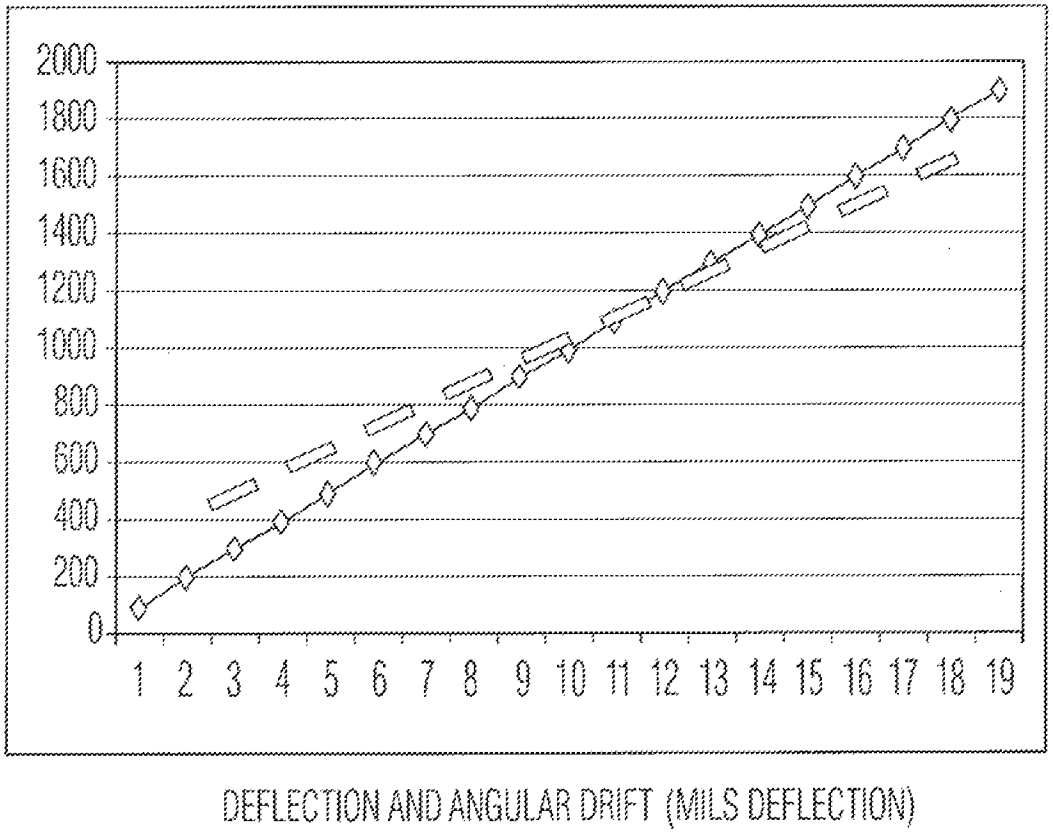
FIG. 11 is a graph of deflection and angular draft versus distance.

The relationship between deflection and angular draft (mils deflection) versus distance is shown in FIG. 11. The ordinate is the distance in meters of projectile travel whereas the abscissa is the mils of deflection in the angle between the two longitudinal axes.

Figure 12:
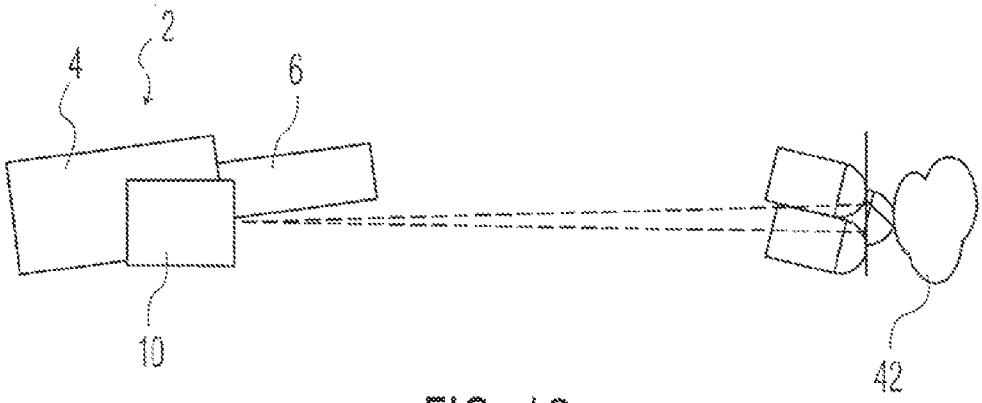
FIG. 12 is a schematic representation of burst fire simulation.
Figure 13:
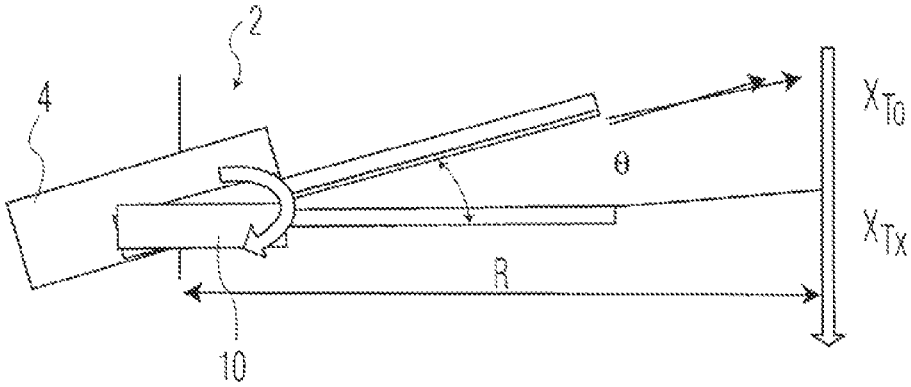
FIGS. 13 to 15 are schematic representations of lateral, top, and rear views, respectively, of a training assembly positioned on a grenade launcher according to the invention.
Figure 14:
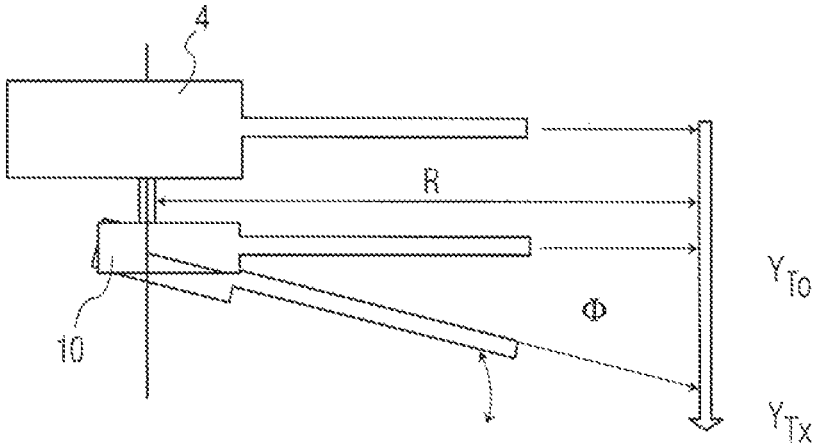
Figure 15:
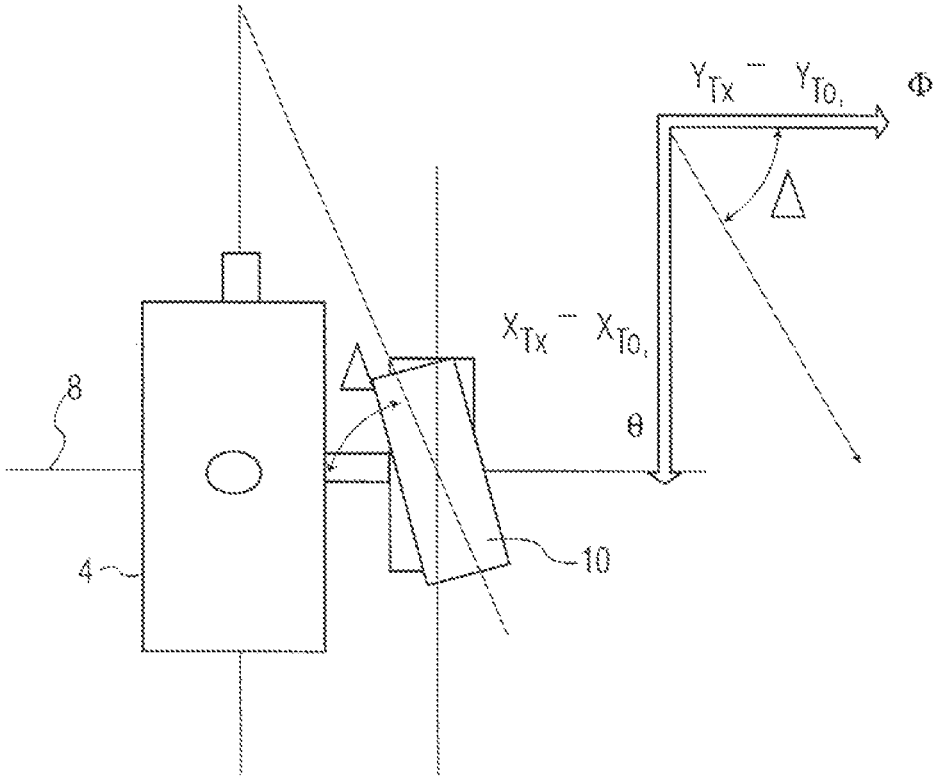

In one aspect of the invention, burst fire can be simulated, as shown in FIG. 12. In this sequence a training assembly 10 or grenade launcher 2 senses multiple blank fires, or bursts. Once the training assembly 10 rotates to the proper deflection, e.g., to horizontal, multiple laser bursts 42 simulate the blank fires. After the shots or bursts cease, the training assembly rotates back to its starting position.

It is possible to select an axis of rotation (relative to the gun barrel) according to the invention that allows for a good approximation and simulation of ballistic drift. The formulas below, which are based upon variables set forth in the schematic representations of FIGS. 13 to 15, express the angular position Δ of the device, about an axis transverse to its rotational axis 8 and longitudinal axis 14, to properly simulate ballistic (flight) drift from time T0 to time TX.

(a) At a given time (range) the change in x (deflection) is expressed as a resultant change in Θ.

(b) At a given time (range) the change in y (drift) is expressed as a resultant change in Φ.

(c) Change in x (deflection) creates a change in y (drift) as determined by the mounting angle Δ.

$$\Delta=\cot(X_{Tx}/Y_{Tx})$$

Hence $$\Delta=\cot(\Theta/\Phi)$$

where $X_{Tx}$ is the x deflection and $Y_{Tx}$ is the y drift from time T0.

In cases where the relationship between x and y is (or near) constant, a single angle provides a satisfactory solution.

The angle is selected for the design use of the (above) geometric relationships along with an analysis of the standard ammunition ballistics. The resulting angle is a device simulates (proper alignment) of a laser impulse corresponding to the drift of a grenade (projectile) in flight.

There has thus been shown and described an improved training system for grenade launchers which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A system useful for training soldiers in the operation and use a grenade launcher having a body and a barrel for simulated firing of a projectile, which system comprises:

a training assembly configured to be rotatably attached to the body of the launcher, comprising:

a housing;

a variable output laser within the housing to produce a laser beam along a longitudinal axis in the direction of a fired projectile;

a shaft configured to connect the housing to the body of the grenade launcher, said shaft having a central axis which is substantially horizontal and transverse to said longitudinal axis;

a motor that engages the shaft and is configured to cause the housing to rotate about the shaft axis;

at least one sensor disposed on the housing to detect the angular position of the housing about the shaft axis with respect to the grenade launcher, a trigger pull of the grenade launcher, and gravitational direction; and a controller disposed on the housing and operatively connected to the laser, to the at least one sensor, and to the motor;

wherein the controller is operative to cause the motor to rotate the housing about the shaft axis such that the laser beam follows the expected flight path of the fired projectile.

2. The system of claim 1, wherein the laser has a focal array to direct the laser beam along the longitudinal axis.

3. The system of claim 1, wherein the controller adjusts the angular position of the housing about the shaft with respect to the grenade launcher, upon initiation of a blank or simulated trigger pull, in dependence upon the direction of earth gravity.

4. The system of claim 1, wherein the training assembly is rotatably connected to the body of the grenade launcher.

5. The system of claim 4, wherein the training assembly is rotatably connected through a connector.

6. The system of claim 1, wherein the training assembly is initially positioned, prior to the trigger pull, so that the longitudinal axis of the laser beam is substantially parallel to a longitudinal axis of the barrel.

7. The system of claim 1, further comprising two or more sensors positioned at an intended target area to detect the received laser energy.

8. The system of claim 1, wherein the motor in the training assembly engages the shaft to rotate the training assembly with respect to the shaft about the shaft axis such that the laser beam is lowered with respect to the barrel of the grenade launcher.

9. The system of claim 1, wherein the training assembly is configured to rotate away from a vertical plane of the grenade launcher, in a y-direction, to simulate expected drift of the projectile due to at least one of rotation of the projectile and the wind.

10. The system of claim 9, wherein the rotation of the training assembly with respect to said vertical plane is configured to simulate drift as the training assembly deflects in the y-direction.

11. The system of claim 1, wherein the sensors in the training assembly detect the direction of earth gravity, the elevation of the training assembly with respect to horizontal or the elevation of the target site, the angle of the training assembly with respect to the elevation of the barrel, and the initiation of a blank or simulated trigger pull.

* * * * *